United States Patent [19]

Shishikura

[11] Patent Number: 5,010,814

[45] Date of Patent: Apr. 30, 1991

[54] METHOD OF NON-OVERLAP HALFTONE-DOT PRINTING OF COLORED ORIGINAL ON CYLINDRICAL CONTAINER OUTER SURFACE

[75] Inventor: Toshibumi Shishikura, Shimizu, Japan

[73] Assignee: Daiwa Can Company, Tokyo, Japan

[21] Appl. No.: 486,104

[22] Filed: Feb. 28, 1990

[30] Foreign Application Priority Data

Mar. 13, 1989 [JP] Japan ..... 1-60240

[51] Int. Cl.[5] ..... B41F 17/22

[52] U.S. Cl. ..... 101/211; 101/40

[58] Field of Search ..... 101/211, 40

[56] References Cited

U.S. PATENT DOCUMENTS 4,519,310 5/1985 Shimizu et al. ..... 101/35

FOREIGN PATENT DOCUMENTS 63-126750 5/1988 Japan .
63-162240 7/1988 Japan .
63-162241 7/1988 Japan .

*Primary Examiner*—Clifford D. Crowder
*Attorney, Agent, or Firm*—Wenderoth, Lind & Ponack

[57] ABSTRACT

A method of non-overlap halftone-dot printing of a colored original on the outer surface of a cylindrical container is done by dry off-set printing. A colored original is color-separated into three primary colors, i.e., cyan, magenta and yellow, change-to-halftone is effected to give an effect of contact screening with the same angle for the individual separated primary colors, and one pixel of print is expressed by three colors at most, i.e., one of the three primary colors, one of three secondary colors, i.e., cyan-magenta, magenta-yellow and yellow-cyan blend colors, and black (tertiary color).

1 Claim, 10 Drawing Sheets

METHOD OF NON-OVERLAP HALFTONE-DOT PRINTING OF COLORED ORIGINAL ON CYLINDRICAL CONTAINER OUTER SURFACE

BACKGROUND OF THE INVENTION

This invention relates to a method of dry offset non-overlap halftone-dot printing of a realistic design with light and shade on the outer surface of cylindrical containers such as a two-piece can (used for accommodating beer, mineral drinks, juices, non-juice drinks and sport drinks and consisting of a can body with an intergral bottom and a lid).

The technique of non-overlap halftone-dot printing on the outer surface of cylindrical containers such as can bodies using a dry off-set printer capable of high speed printing is well known in the art (as disclosed, for instance, in Japanese Patent Laid-open Publication No. 162241/1988).

The Japanese Patent Laid-open Publication No. 162241/ 1988 has disclosed a printing method comprising the steps of color separation of a colored original of realistic design into seven colors, i.e., cyan, magenta, yellow (these three colors being herein after sometimes referred to as primary colors), blended cyan-magenta, blended magenta-yellow, blended yellow-cyan (these three colors being hereinafter sometimes referred to as secondary colors) and black (this color being hereinafter sometimes referred to as tertiary color), producing plates having raised portions corresponding to contracted images of the individual colors obtained by the color separation, for each color, supplying inks of seven different colors, kneaded with a number of ink kneading rollers on to the raised portions of the individual plates set on a plurality of plate cylinders, transferring the inks on the individual raised portions onto a common blanket provided on a transfer roller, and further transferring all the inks from the blanket simultaneously onto a cylindrical can body supported on a rotor.

The term "cyan", "magenta" and "yellow" as used herein may respectively include any resembling colors thereof. For example, cyan means cyan and any color resembling cyan.

For producing the plates used in the aforementioned printing method, the color components of the colored original are first separated into four colors, i.e., three primary colors of cyan, magenta and yellow, and black. Then, according to a conventional method the change to half tone is effected by screening the respective colors at different angles. Subsequently, those portions of dot areas of halftone images of cyan and magenta that overlap with each other to give a resultant optical image of a secondary color of cyan-magenta in the colored original are changed to corresponding areas of blended cyan-magenta, those portions of dot areas of halftone images of cyan and yellow that overlap with each other to give a resultant optical image of a secondary color of cyan-yellow are changed to corresponding areas of a blended cyan-yellow, those portions of dot areas of halftone images of magenta and yellow that overlap with each other to give an optical image of a secondary color of magenta-yellow in the colored original are changed to corresponding areas of blended magenta-yellow and those portions of dot areas of halftone images of cyan, magenta and yellow that overlap all together to give an optical image of a tertiary color in the colored original are changed to corresponding areas of tertiary color. Further, those portions of dot areas of halftone images of cyan, magenta, yellow and black that overlap all together to give an optical image of tertiary color in the color original are changed to corresponding areas of tertiary color. In this way, the color components of the colored original are changed to seven color elements. Thereafter, the individual halftone-dot images are contracted, and then plates having raised portions corresponding to the individual contracted images are produced.

In this printing method, in addition to inks of the basic colors, i.e., cyan, magenta, yellow and black, inks of intermediate colors, i.e., cyan-magenta, magenta-yellow and yellow-cyan, are used. Thus, it is possible to obtain a print of a realistic colored original with light and shade by using a non-overlap printing method.

However, in the above prior art method the change to halftone for the four basic separated colors obtained from the colored original is done in the conventional way of screening at different respective angles for the four basic colors. Therefore, when the halftone-dot images of three colors, i.e., cyan, magenta and yellow, obtained after change-to-halftone, are overlapped to produce a compounded image reproducing the image of the colored original, individual dots of respective colors are arranged to produce a pixel to form a compounded image reproducing the image of colored original as shown in FIG. 10(1), for instance. By changing the area where cyan and magenta overlap each other to an area of blended cyan-magenta CM, the area where magenta and yellow overlap each other to magenta-yellow MY, the area where yellow and cyan overlap each other to yellow-cyan YC and the area where the three colors overlap all together to tertiary color B, resultant color elements are arranged as shown in FIG. 10(2). In this case, the shape and sizes of the individual dots for respective colors are as shown in FIG. 10(3).

As is shown, since a pixel representing an intermediate color according to the prior art method is expressed by a combination of at most seven colors, the individual plates essentially have to have an extremely large number of small dots as shown in FIG. 10.

When such plates are used for dry off-set printing, a phenomenon called "dot gain" takes place, i.e., dots and lines are enlarged on the printed surface. This may make highlight areas of the print darker or destroy an original color balance. If image reduction is effected in advance of producing the plates to make up for the dot gain at the time of the off-set printing, small dots may be reduced to such extent that they do not appear on the plates. When such on plates are used for printing, highlight areas of the print may not be reproduced. Thus, extreme deterioration of the image quality of the print is inevitable.

U.S. Pat. No. 4,519,310 discloses a technique of halftone-dot printing on the outer surface of a cylindrical container such as a can body using a dry off-set printer. According to this technique of halftone-dot printing (of either non-overlap or overlap type) on the cylindrical container outer surface, inks kneaded by a plurality of ink rollers are transferred onto the raised portions of plates set on a plurality of plate cylinders and then onto each blanket provided on a transfer roller, the ink on each blanket is transferred onto a can body supported on each can support of a rotor, one color per a revolution of the can body, and the rotation of the transfer roller is synchronized with the rotation of the rotor.

With this printing technique, mixing of individual inks is prevented by setting different tack values for the respective inks such that it is the ink with the highest tack value which is first transferred onto the can body and the tack values of the respective inks become gradually lower in the order of transfer onto the can body.

This printing technique, however, has the following disadvantages.

(1) Even where only the basic four colors are used in printing, the can body has to be rotated four rotations so that the printing speed is reduced to at least one-fourth of that of a conventional printer.

(2) The can support for supporting the can body requires a complicated mechanism for reliably holding the can body during printing and a mechanism for providing high accuracy of synchronized rotation to avoid off-registration of the respective colors. Therefore, the printer must have extremely high accuracy.

(3) Where an ink overlaps with another ink which has not been baked dry, it is necessary to provide the inks with different tack values in order to prevent reverse trapping of an ink (i.e., a phenomenon of pulling an ink transferred onto the can body by another ink), and control and maintenance of such a tack difference is complicated and difficult.

This technique, therefore, can not solve the problems which the present invention seeks to solve.

Japanese Patent Laid-open Publication No. 126750/1988 discloses a different printing method. In this method, a color design to be provided on the outer surface of a cylindrical container is color-separated into color components of like color hue which are not affected by mixing of inks, and inks of the like color hue obtained by the color-separation are prepared. Each plate is formed for an image of each like color hue. Each ink kneaded by a number of ink rollers is supplied to raised portions of each plate set on a plurality of plate cylinders and transferred onto a common blanket provided on a transfer roller. Inks of all colors on the blanket are simultaneously transferred onto the cylindrical container supported on the rotor. The rotation of the transfer roller is timed with that of the rotor to effect continuous printing by a dry off-set printing.

This method has the following disadvantages.

(1) Since the color design is color-separated into like color hues, sophisticated color balance control is required, and the color separation is complicated and difficult.

(2) The color-separation of a color design into like color hues means that a color design consisting of a plurality of different color hues have to be separated into a larger number of colors. Therefore, where the available number of colors is limited, a desired color design may not be used for printing. The application of this printing method, therefore, is limited to color designs consisting of like color hues.

Japanese Patent Laid-open Publication No. 162240/1988 also discloses a method of printing and a method of producing plates used for the same printing as disclosed in Japanese Patent Laid-open Publication No. 162241/1988. With these methods, a color design to be provided on the outer surface of a cylindrical container is color-separated into seven different colors, i.e., cyan, magenta, yellow, cyan-magenta, magenta-yellow, yellow-cyan and black, plates with raised portions corresponding to contracted images of the separated colors are produced for each color, seven different color inks kneaded by many ink kneading rollers are supplied to the raised portions of the plates set on a plurality of plate cylinders and are transferred onto a common blanket provided on a transfer roller, and the inks of all colors on the blanket are simultaneously transferred onto a cylindrical can body supported by a mandrel on a rotor.

With these methods, however, one intermediate color pixel of the color design to be printed on the cylindrical container outer surface is expressed by a combination of at most seven different colors. Therefore, the individual plates essentially have to have extremely larger numbers of small dots. The use of such plates for dry off-set printing leads to a phenomenon called "dot gain", i.e., the size increase of dots and lines, resulting in the size increase of dots on the surface to be printed. Therefore, highlight areas may become darker, or the color balance may be destroyed. If an image reduction is made in producing the plates to make up for the dot gain, small dots may be reduced to such extent that they disappear from the plates. With such plates, reproduction of a highlight area can not be obtained, or at any rate, the image quality of a print is extremely deteriorated.

SUMMARY OF THE INVENTION

The invention seeks to solve the above problems. More specifically, the invention has an object of providing a method of non-overlap halftone-dot printing of a colored original, minimizing number of small halftone dots on each plate and deterioration of image quality of print due to dot gain or image reduction, by using a known high-speed dry off-set printer.

To attain the above object of the invention, there is provided a method of non-overlap halftone-dot printing of a colored original on a cylindrical container outer surface by off-set printing comprising the steps of:

color separation of a colored original of a print to be provided on the outer surface of a cylindrical container into three primary colors, i.e., cyan, magenta and yellow;

effecting change-to-halftone to convert color density of each of the three primary colors obtained by said color separation into proportional dot areas;

changing those portions of the dot areas of each of said primary colors that overlap with the dot areas of either one of the other primary colors to give a resultant optional image of a secondary color in the colored original into corresponding dot areas of the secondary color obtainable by blending two of the three primary colors with each other i.e., cyan-magenta, magenta-yellow or yellow-cyan;

changing those portions of the dot areas of each of the primary colors that overlap with the dot areas of the other two primary colors in the colored original into corresponding dot areas of a tertiary color obtainable by blending the three primary colors together;

making an offset printing plate for each of the respective primary, secondary and tertiary colors with raised portions representing printing elements in the plate being so arranged that an image produced by the plate for any one of the primary, secondary and tertiary colors does not overlap with images produced by said plates for the other colors to give a compounded image reproducing the colored original;

kneading an ink of each of the primary, secondary and tertiary colors respectively by a plurality of ink distributing rollers and supplying it to the raised portions of the plate for a corresponding color;

transferring each kneaded ink on the raised portions of the plate one color after another onto a common offset printing blanket, and further transferring the inks of all colors on the blanket at one time onto the outer surface of the cylindrical container, wherein the change-to-halftone takes place to give an effect of contact screening at the same angles for all the primary colors and that any one pixel (a pixel being equivalent to a unit of square defined by a screen pitch in a contact screening), to produce the compounded image on the outer surface of the cylindrical container, consists of at most three colors, including one of the three primary colors, one of three secondary colors obtainably by blending any two of the three primary colors, and the tertiary color.

DETAILED DESCRIPTION OF THE PREFERRED EMBODIMENT

The features of the invention reside in the way of effecting change to halftone and color change to form a pixel of a colored halftone image with at most three colors. These features will now be described with reference to FIG. 3, which shows a method of forming a pixel of intermediate color between magenta M and blended magenta-yellow MY.

Figure 3:
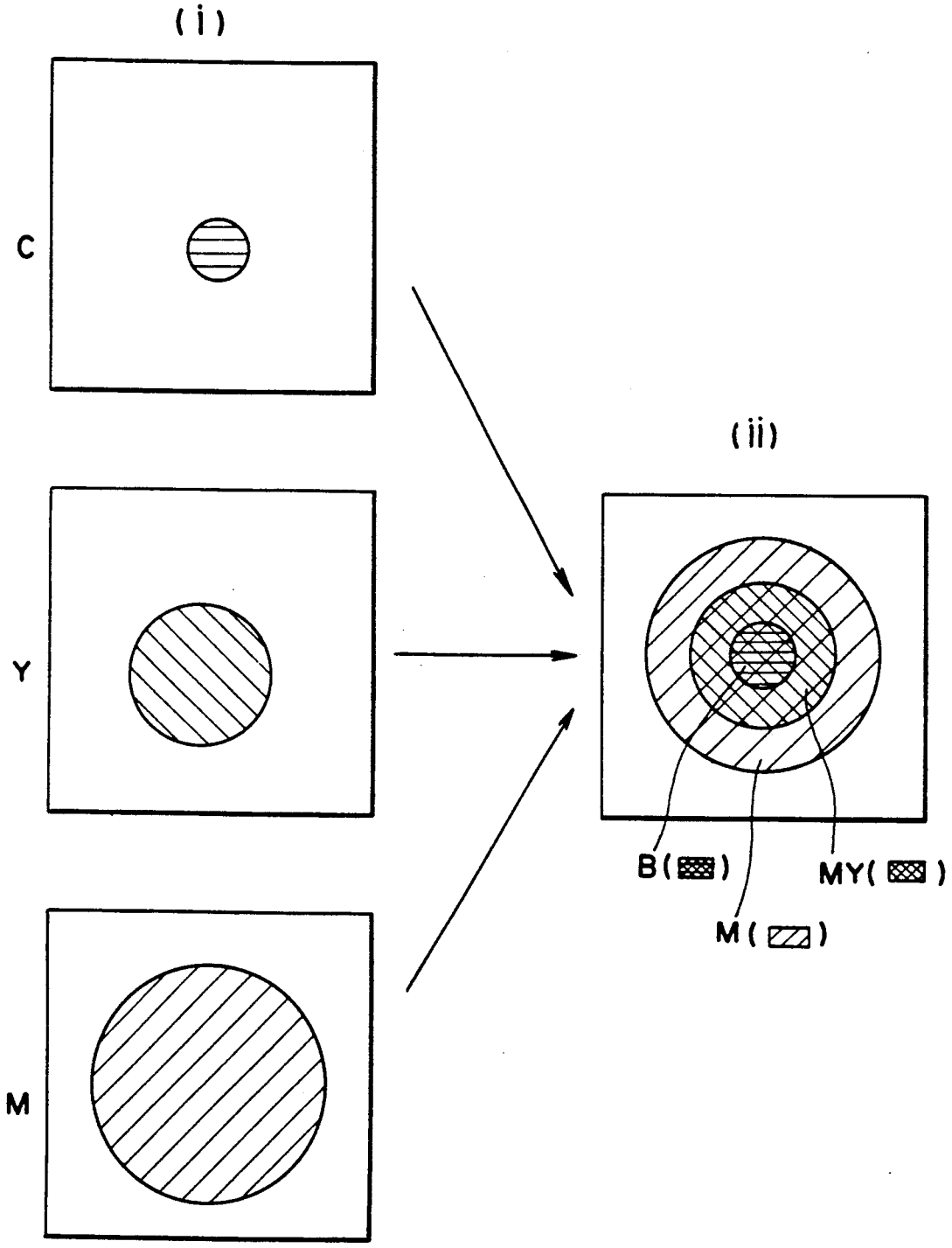
FIG. 3 is a view showing a system to express an intermediate color between magenta and magenta-yellow.

FIG. 3(i) shows the respective dots for the primary colors of cyan C, magenta M and yellow Y prepared by change to halftone to give an effect of contact screening at the same angles to respective images of the three primary colors obtained by color separation. FIG. 3(ii) shows a pixel that expresses an intermediate color between magenta M and blended magenta-yellow MY by combination of a tertiary color, a secondary color of blended magenta-yellow MY and a primary color of magenta M which are arranged in this order from the innermost portion. Likewise, any other intermediate colors are also expressed by a pixel of at most a threefold color structure as shown in FIG. 3, with a color of higher blending order being always arranged in inner part of the pixel.

In the method of non-overlap halftone-dot printing on the outer surface of a cylindrical container according to the invention, a colored original of a print to be provided on the outer surface of a cylindrical container undergoes color separation to separate the color components into three primary colors of cyan C, magenta M and yellow Y, change to halftone is preformed to give an effect of contact screening to the respective images of the three primary colors at the same angles, those portions of the dot areas of each of the images of the three colors that overlap with dot areas of either one of the images of the other two colors to give a resultant optical image of a secondary color in the colored original are changed to corresponding dot areas of the secondary color obtainable by blending such two colors, and those portions of dot areas of the images of the three colors that overlap all together to give a resultant optical image of a tertiary color in the colored original are changed to corresponding dot areas of the tertiary color obtainable by blending the three colors so that each pixel is expressed by a combination of at most three colors including one of the primary colors, one of the secondary colors and the tertiary color. Subsequently, a plate for each of the primary, secondary and tertiary colors is respectively made with raised portions representing printing elements being so arranged that the image of any one of the primary, secondary and tertiary colors does not overlap with the images of the other colors to give a compounded image reproducing the colored original. Thus, compared to the prior art method where one pixel is expressed by at most, seven colors, small dots on each plate are substantially reduced by the method according to the invention, and when the outer surface of a cylindrical container is printed with a dry off-set printer using inks and plates for respective primary, secondary and tertiary colors, deterioration of the image quality due to dot gain and image reduction is minimized. As a result, it is possible to obtain non-overlap halftone-dot printing image on a cylindrical container more similar to an image obtainable by overlap halftone-dot printing.

EXAMPLE

Now, an example of the invention will be described with reference to the drawings.

Figure 1:
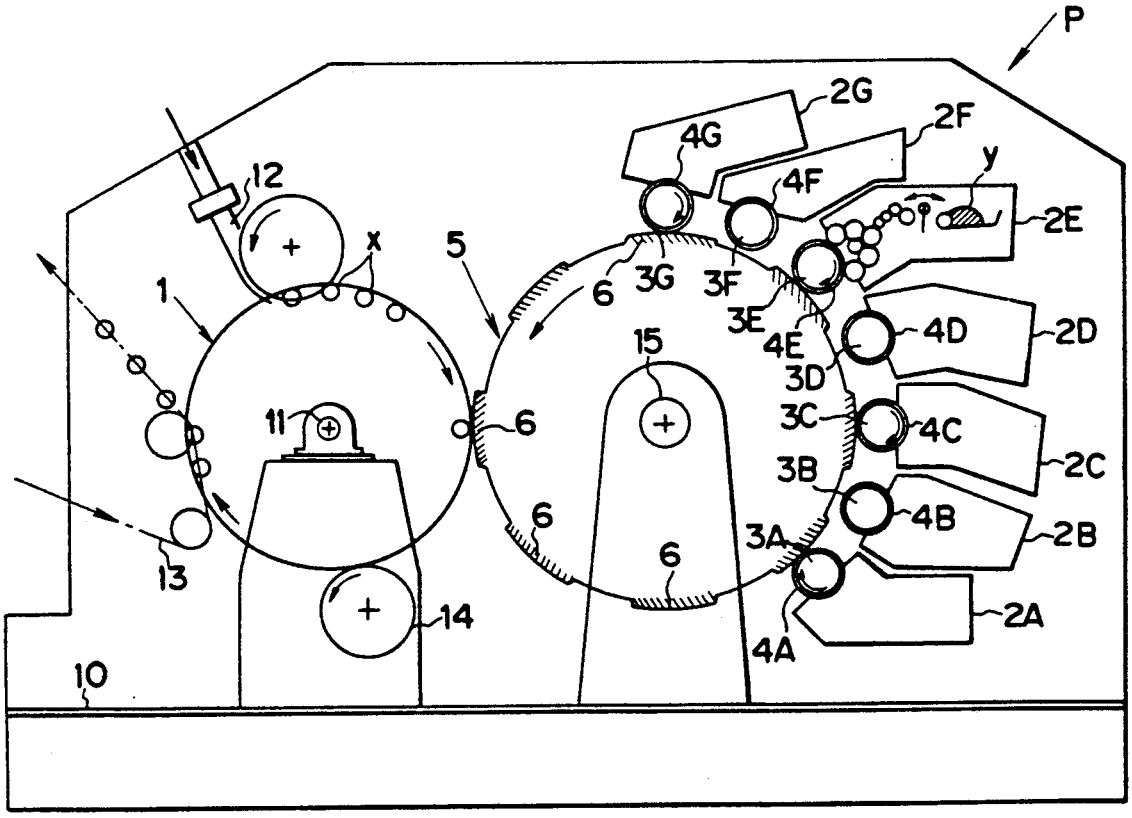
FIG. 1 is a schematic view showing an example of a dry off-set printer used for the non-overlap halftone-dot printing according to the invention.
Figure 2:
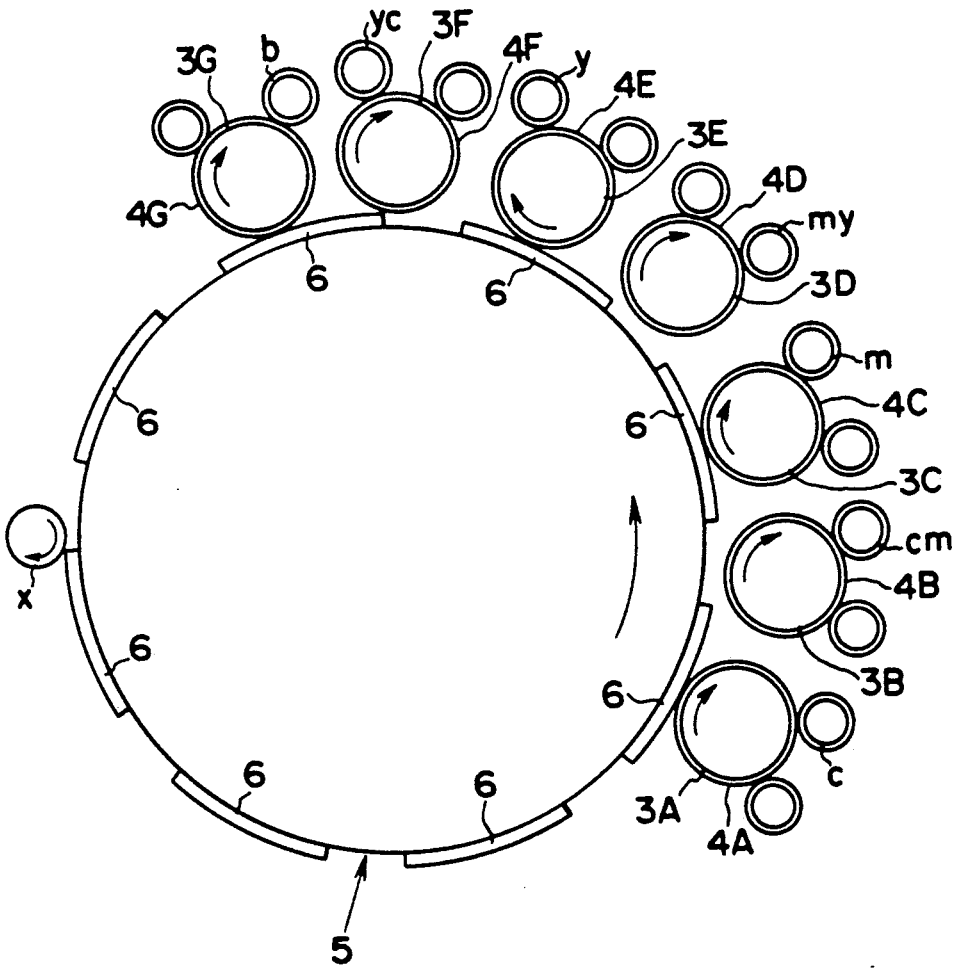
FIG. 2 is a schematic view showing the relation between each plate set on a plate cylindrical in the dry off-set printer and each blanket provided on a transfer roller.

FIG. 1 is a schematic view showing a known dry off-set printer P that may be used for the method of non-overlap halftone-dot printing according to the invention, and FIG. 2 is a schematic view showing the relation between each plate being set on a plate cylinder and each blanket provided on a transfer roller of the dry off-set printer.

Raised dot portions provided on each plate, an ink supplied onto the raised portions and the inks transferred onto the outer surface of a cylindrical container have been omitted simply because of difficulty of illustration.

This embodiment concerns a method of non-overlap halftone-dot printing of a colored image on the outer surface of a two-piece can body (i.e., a cylindrical container).

Construction of the dry off-set printer P used for the method of this embodiment will now be described.

Printer P, as shown in FIG. 1, mainly comprises a rotor 1, ink distributing roller assemblies 2A to 2G, plate cylinders 3A to 3G, plate 4A to 4G, a transfer roller 5 and a plurality of blankets 6. Although not shown, individual plates 4A to 4G have raised portions onto which inks are supplied.

The rotor 1 is a means for revolvingly feeding can bodies X to be printed. The rotor is supported by a shaft 11 which is rotatably held in bearings on a base 10. Mandrels (not shown) for rotatably supporting can bodies X are provided at a uniform spacing along the periphery of the rotor 1.

Provided above the rotor 1 is a chute 12 for supplying can bodies X into the printer. A discharge conveyor for transferring printed can bodies to a next process is provided adjacent to and underneath the rotor at the opposite side of a printing station where a can body on a mandrel and a blanket on the transfer roller 5 come into rolling contact with each other. Also under the rotor 1 is a varnishing roller 14 to apply a finish coating over the print on can bodies X.

Aforementioned ink distributing roller assemblies 2A to 2G are the means for kneading inks and supplying the kneaded inks onto the raised portions of the plates 4A to 4G being set on the plate cylinders 3A to 3G. As typically shown for the assembly 2E, each distributing roller assembly includes an ink fountain and a number of rollers.

The ink kneading roller assemblies 2A to 2G are respectively used for cyan ink c, cyan-magenta ink cm, magenta ink m, magenta-yellow ink my, yellow ink y, yellow-cyan ink yc and black ink b.

The plate cylinders 3A to 3G carry respective plates 4A to 4G on their outer periphery, serving as the means for transferring inks c, sm, m, my, y, yc, and b on the raised portions of the plates 4A to 4G (the inks on the raised portions is not shown) onto the plurality of blankets 6 provided on the transfer roller 5. The plate cylinders 3A to 3G are so arranged that each plate is in rolling contact with a distributing roller of corresponding ink distributing roller assemblies 2A to 2G. (FIG. 2).

The transfer roller 5 is a means for transferring inks of all colors c, cm, m, my, y, yc and b on a blanket 6 simultaneously onto the outer surface of a can body X supported by a mandrel on the rotor 1. This roller 5 is supported by a shaft 15 which is rotatably held in bearings on the base 10.

The transfer roller 5 and the rotor 1 are rotated in a timed relation to each other for continuously transferring the inks on the blankets 6 onto can bodies X revolvingly fed one after another.

The non-overlap halftone-dot printing in this embodiment will now be described in respect to a method of plate-making and a method of printing respectively.

(A) Method of Plate-Making

Methods of plate-making from a colored original of a design to be printed on the outer surface of a can body X using a known general-purpose computer or a layout scanner and using conventional film work techniques will now be described.

Figure 4:
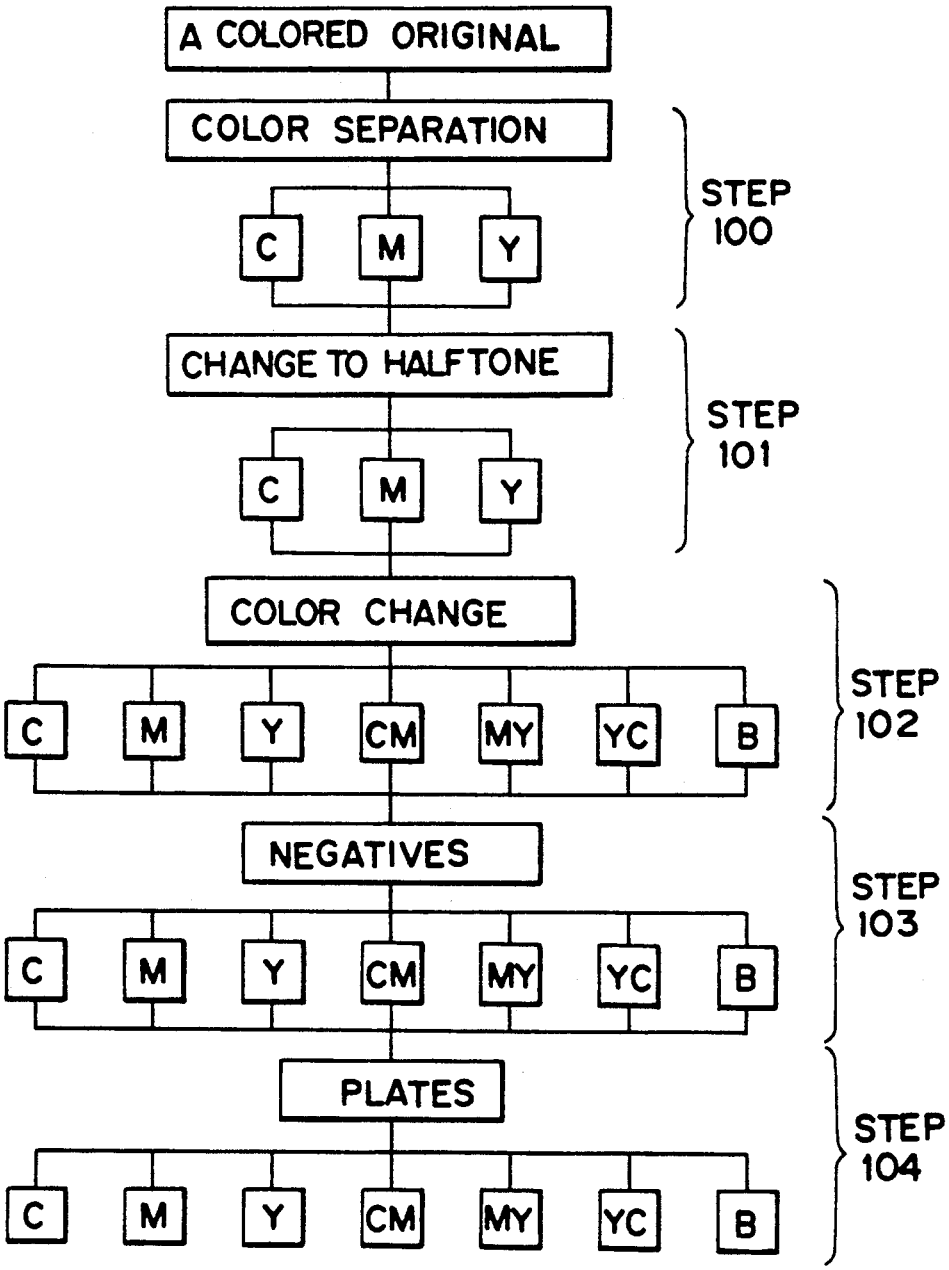
FIG. 4 is a flow chart of an operation of producing plates used in the invention by means of a computer or a color scanner.

(i) Method of plate-making using a known general-purpose computer or a layout scanner:

This method of plate-making will be described with reference to the flow chart shown in FIG. 4.

In the step 100, color components of the colored original are separated using a known color scanner into three primary colors of cyan C, magenta M and yellow Y and converted to data having both color and density information (hereinafter referred to as density image data).

In the subsequent step 101, "change to halftone" to convert color density of the respective three primary colors to proportional dot areas by giving an effect of contact screening at the same angles for the three colors is performed using a known general purpose computer or a layout scanner so that the density image data is converted to binary image data having information on the three colors of cyan C, magenta M and yellow Y as to whether the respective colors are present or not (hereinafter referred to as binary image data).

In the subsequent step 102, color changes are made to the binary image data for respective cyan C, magenta M and yellow Y using the computer or scanner. In this step, those portions of the images of cyan C and magenta M that overlap with each other are changed to an image of blended cyan-magenta CM, those portions of the images of magenta M and yellow Y that overlap with each other are changed to an image of blended magenta-yellow MY, those portions of the images of yellow Y and cyan C that overlap with each other are changed to an image of blended yellow-cyan YC and those portions of the images of cyan C, magenta M and yellow Y that overlap all together are changed to an image of black B.

Thus, in the color changes any one of pixels to form a compounded image reproducing the image of the colored original is expressed by a combination of at most three colors, i.e., one of the primary colors, one of the secondary colors and the tertiary color, so that the compounded image to reproduce the entire image of the colored original is expressed by at most seven colors, i.e., the primary colors C, M and Y, the secondary colors CM, MY and YC and tertiary color B.

Figure 10:
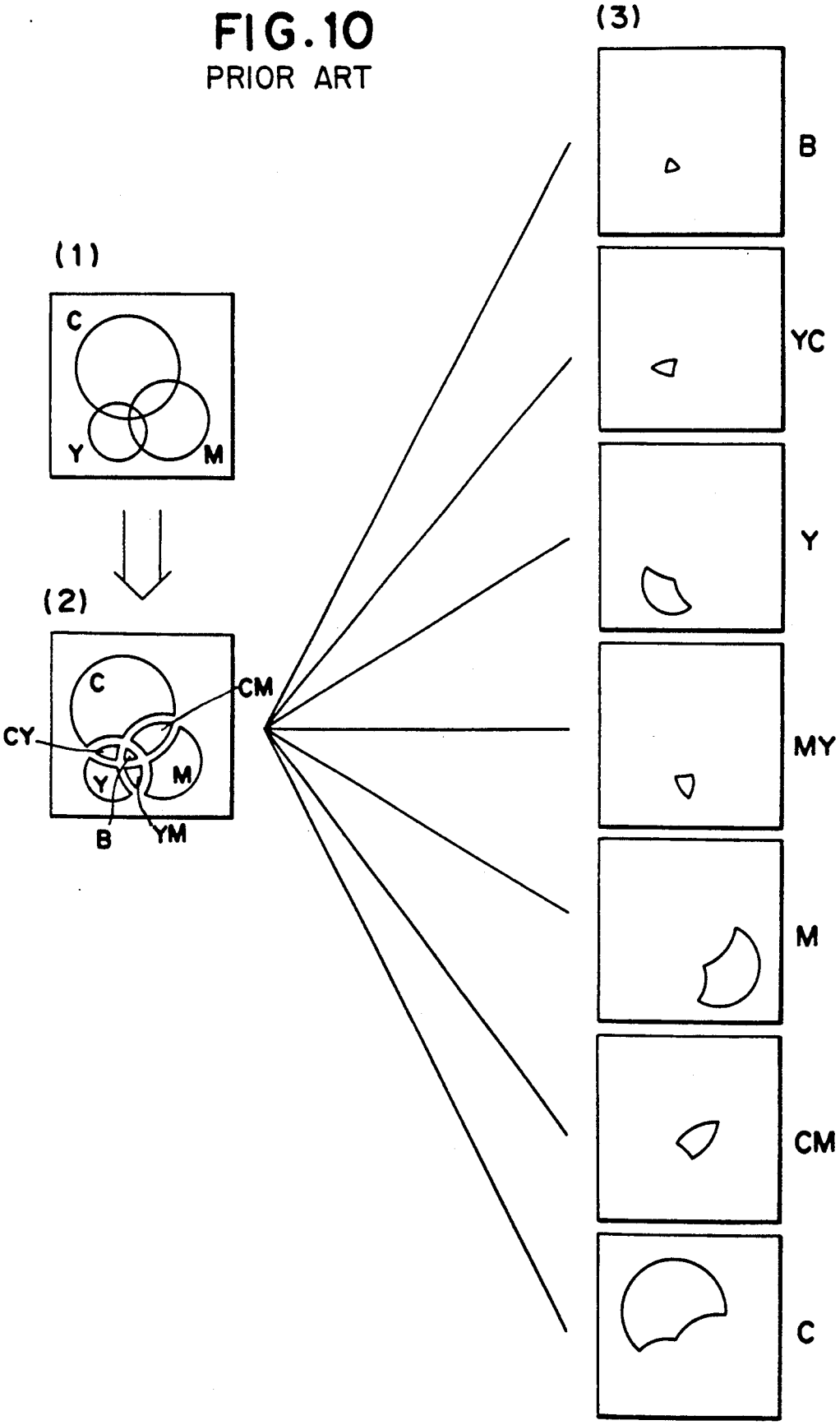
FIG. 10 PRIOR ART
FIG. 10 is a view showing an example of plate produced with prior art techniques, and showing in (1) overlap of dots of colors of one pixel when change-to-halftone is made to the respective three primary colors, i.e., cyan C, magenta M and yellow Y by giving an effect of contact screening at different angles for the respective colors, (2) color change of areas of color overlap and (3) the shape and size of individual color plates representing the pixel.

Conventionally, the change-to-halftone is not performed at the same angles of screening for the three primary colors, so that each pixel forming a compounded image reproducing the image of the colored original is expressed by at most seven colors (FIG. 10).

In the prior art methods, the entire compounded image to reproduce the image of the colored original is composed of at most seven colors as used in the method according to this invention.

In the subsequent step 103, negatives are produced for the respective seven colors from the binary image data using a known layout scanner.

In the subsequent step 104, plates 4A to 4G are produced for the respective seven colors from the negatives produced in the step 103.

Figure 5:
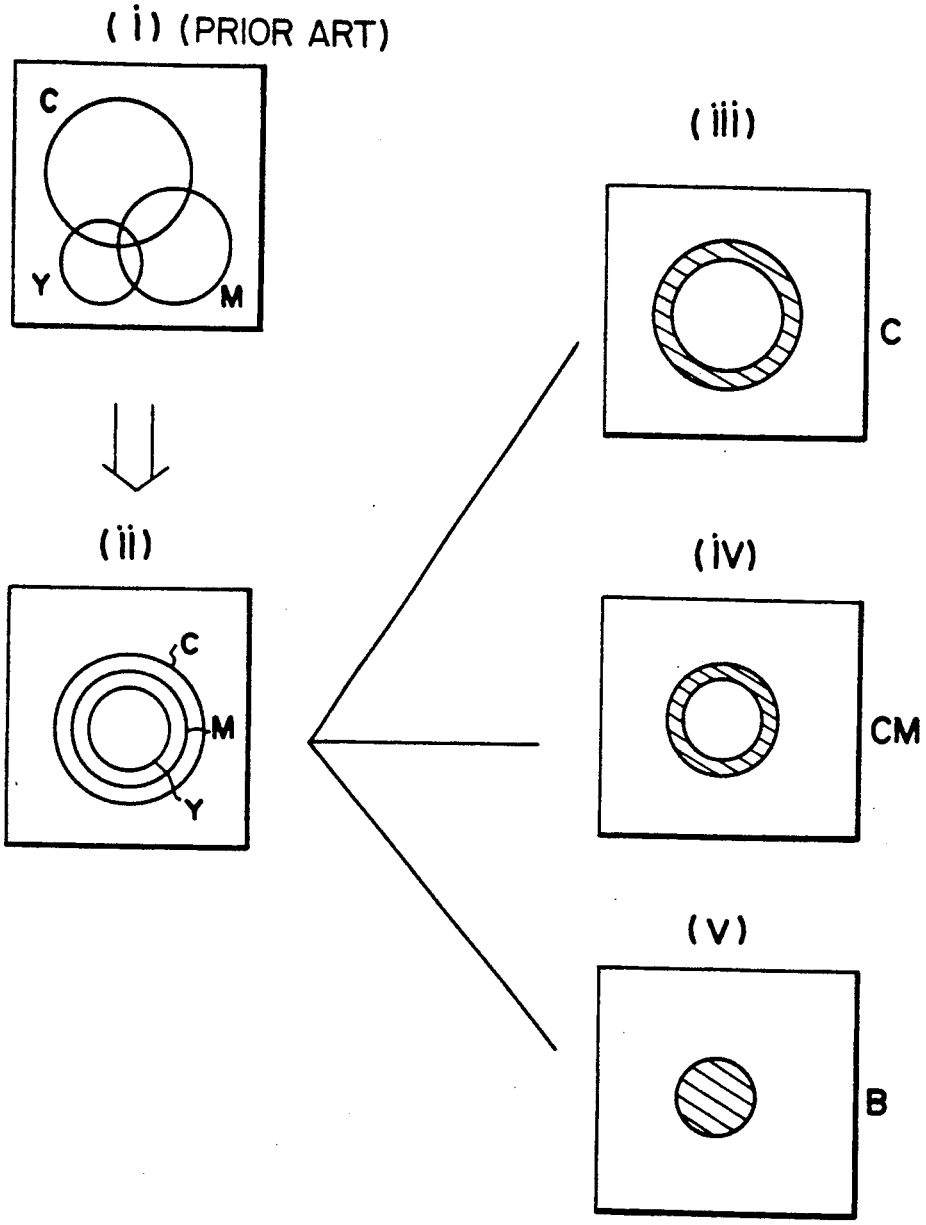
FIG. 5 is a view showing (i) overlap of dots by colors when the change-to-halftone is made to the respective three primary colors, i.e., cyan C, magenta M and yellow Y, by giving an effect of contact screening at different angles for the respective colors (prior art method), (ii) overlap of dots of colors when the change-to-halftone is effected by giving an effect of contact screening at the same angles for all the three colors (a method according to the invention), and (iii), (iv) and (v) the areas of primary, secondary and tertiary colors after the color change in the latter method.

In reference to FIG. 5, (i) shows an overlap of dots of colors when the change-to-halftone is made to the respective three primary colors C, M and Y by giving an effect of contact screening at different angles for the respective colors (prior art method), (ii) shows an overlap of dots of colors when the change-to-halftone is effected by giving an effect of contact screening at the same angles for all the three colors (a method according to the invention), and (iii), (iv) and (v) shows the areas of primary, secondary and tertiary colors after the color change in the latter method.

(ii) Method of plate-making by film work technique.

Figure 6:
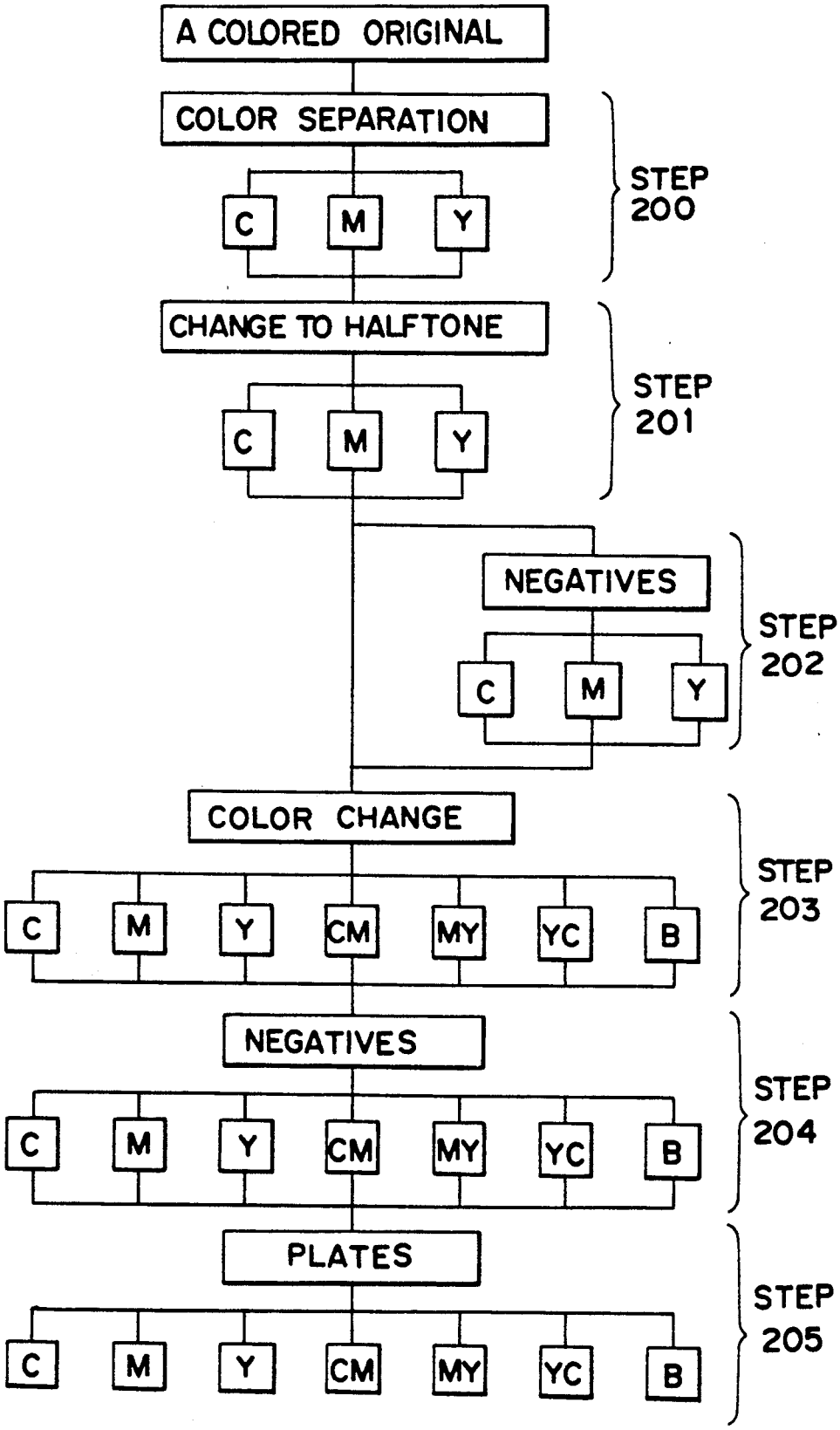
FIG. 6 is a flow chart of an operation of producing plates with film work.

The method of plate-making by film work technique will now be described with reference to the flow chart of FIG. 6

In the step 200, color components of a colored original are separated using a known color scanner into three primary colors of cyan C, magenta M and yellow Y.

In the subsequent step 201, "change-to-halftone" to convert color density to proportional dot areas is effected using a known color scanner by giving an effect of contact screening at the same angles for the three colors of cyan C, magenta M and yellow Y such that dot areas of each color are always centered with dot areas of either one or both of the other colors to produce a secondary color or tertiary color and then positives of the dot images for the positives of the respective three colors are produced.

In the subsequent step 202, negatives are produced from the positives produced in the step 201.

Figure 7:
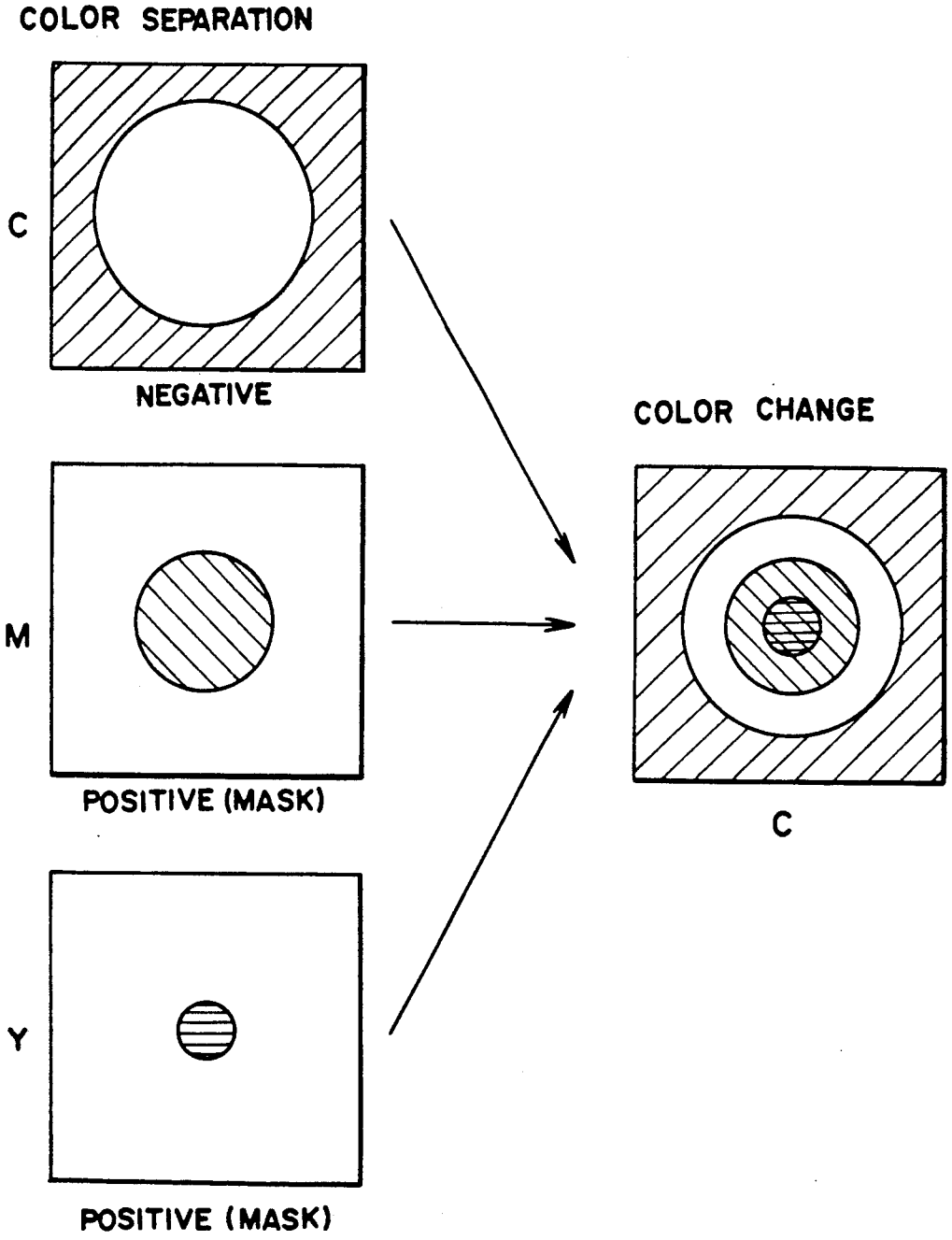
FIGS. 7 to 9 are views illustrating examples of plate making with film work.
Figure 8:
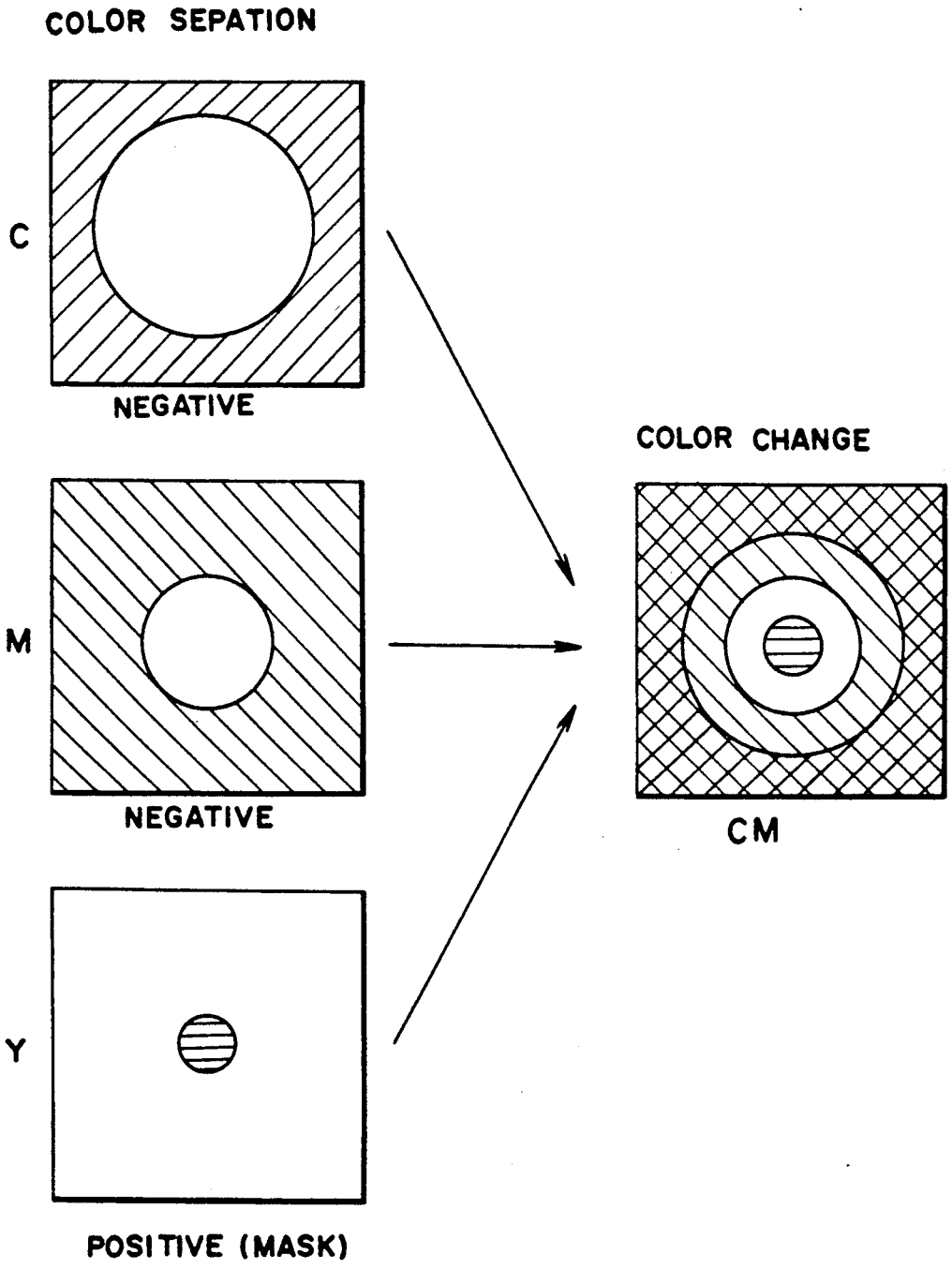
Figure 9:
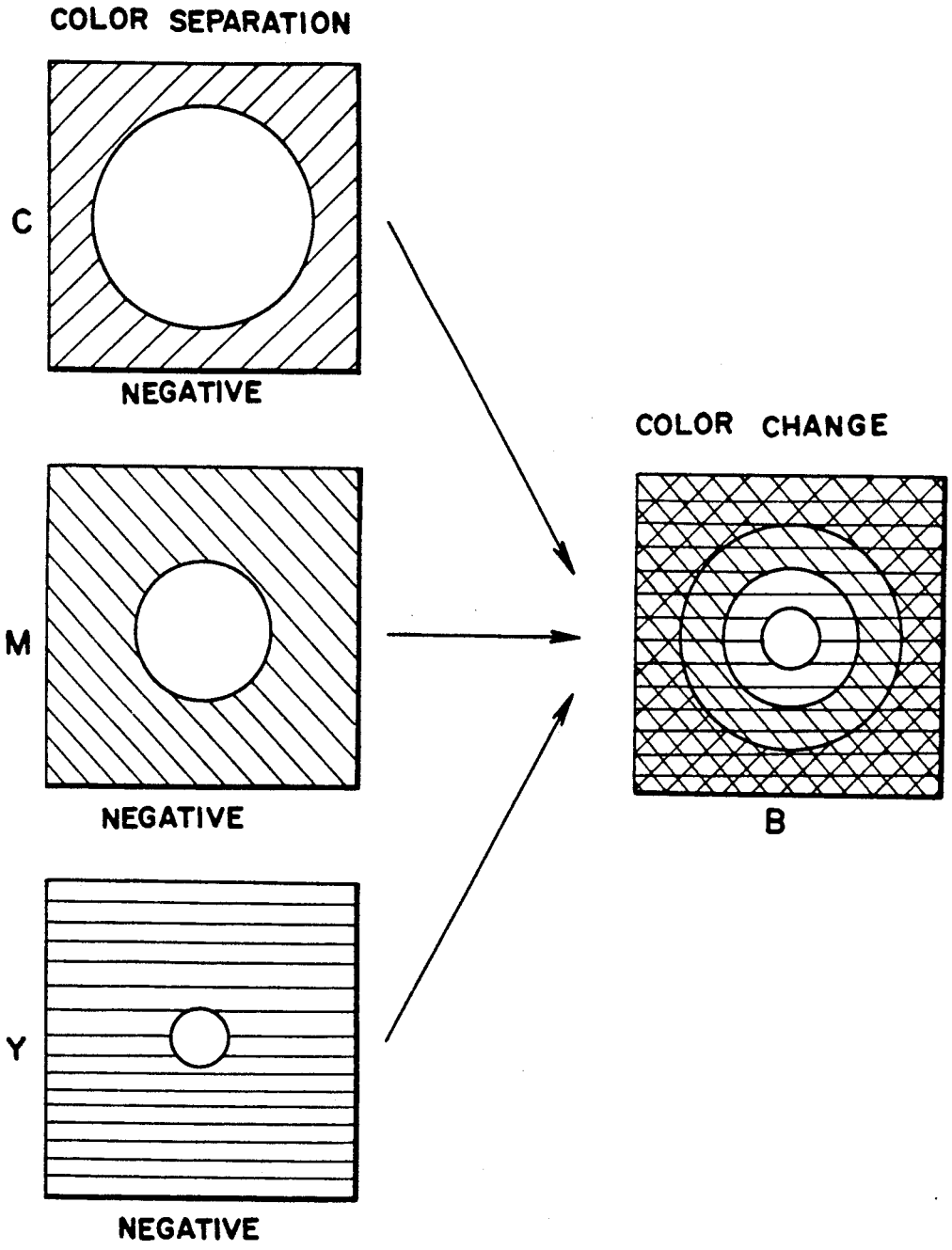

In the subsequent step 203, color-changed positives are produced from the negatives produced in the step 202 by masking the negatives with the positives produced in the step 201. For example, when a color-changed positive is to be produced from a negative of the primary color of cyan C, the magenta M and yellow Y positives are used for masking the cyan C negative as shown in FIG. 7. When a positive of the secondary color of blended cyan-magenta CM is to be produced, the yellow Y positive is used for masking the cyan C and magenta M negatives as shown in FIG. 8. A color-changed positive of tertiary color is produced from the cyan C, magenta M and yellow Y negatives, as shown in FIG. 9. Likewise, the other primary and secondary color positives are also produced in the same manners as shown in FIG. 7 (primary color) and FIG. 8 (secondary color). Thus, all the seven color positives are produced.

As a result of these color changes, each pixel forming a compounded image to reproduce the image of the colored original is expressed by a combination of at most three colors, i.e., one of the primary colors, one of the secondary colors and the tertiary color.

Also, the entire compounded image reproducing the image of the colored original is expressed by at most seven colors, i.e., three primary colors, three secondary colors and one tertiary color.

In the step 204 negatives are produced from the respective positives of seven colors produced in the step 203.

In the subsequent step 205, plates 4A to 4G are produced for the respective seven colors from the negatives produced in the step 204.

(B) Method of Printing

Prior to printing using the dry off-set printer P as shown in FIG. 1, plates 4A to 4G produced by either plate-making method described as above are set on corresponding plate cylinders 3A to 3G, and inks c, cm, m, my, y, yc and b of cyan C, blended cyan-magenta CM, magenta M, blended magenta-yellow MY, yellow Y, blended yellow-cyan YC and black B are supplied to ink distributing roller assemblies 2A to 2G.

For the blended colors cyan-magenta CM, magenta-yellow MY and yellow-cyan YC, inks cm, my and yc having color tone equivalent to that of corresponding blended colors produced by overlap printing by respective two colors are used.

While the printer P is in operation, inks c, cm, m, my, y, yc and b kneaded by a number of ink distributing rollers are supplied to raised portions of the plates 4A to 4G.

Then, respective inks c, cm, m, my, y, yc and b on the raised portions of the plates are sequentially transferred one after another onto a same blanket 6 provided on the transfer roller 5 as shown in FIG. 2 (inks being not shown). Just when each blanket 6 has cleared the last plate cylinder 3G, the blanket carries inks of all colors c, cm, m, my, y, yc and b. When the blanket 6 with inks of all the colors comes to the printing station to meet a can body X revolvingly fed by the rotor 1, the inks of all the colors on the blanket are simultaneously transferred onto the outer surface of the can body X while the blanket and the can body X moving at the same circumferential speed are in rolling contact each other (the transferred inks not shown).

The outer surface of can body X revolvingly fed by the rotor 1 is provided in advance with white base coating.

Thus, a print of a realistic colored design having a quality very close to that obtainable by overlap halftone-dot printing can be made to the surface of the can body X by using the dry off-set printer P.

Depending on a colored original, some of the aforementioned colors may not be used at the time of the color changes. In such case, neither plate making nor printing is effected with respect to such colors that are not to be used.

While a specific embodiment of the method according to the invention has been described with reference to the drawings, the method is by no means limited by this embodiment, and the methods of plate-making and printing and a printer used may be variously changed or modified without departing from the scope of the invention.

For example, while the above embodiment has concerned with printing on can bodies X of two-piece cans, the invention is applicable as well to other containers so long as these containers are cylindrical.

Further, while in the above embodiment the colors of inks supplied to the respective plates on the plate cylinders 3A to 3G are arranged in the order of cyan C, cyan-magenta blend color CM, magenta M, magenta-yellow MY, yellow Y, yellow-cyan YC and black B, such order of arrangements is by no means limitative, and for example, a color order from brighter to darker colors of inks may be adopted.

Further, while in the above embodiment an example of the of a general-purpose computer or a layout scanner and an example of use of film work technique have been discussed for color separation of the colored original into final seven colors, the invention also covers any other methods of color separation other than those described above so far as one pixel is expressed by a combination of at most three colors, i.e., one of the primary colors, one of the secondary colors and the tertiary color by such other methods.

Further, while in the above embodiment the halftone dots are circular in shape, the invention is applicable as well to dots having other shapes.

As has been described in the foregoing, in the method of non-overlap halftone-dot printing on the outer surface of a cylindrical container according to the invention, a colored original of a print to be provided on the outer surface of the cylindrical container undergoes color separation to separate the color components into three primary colors of cyan C, magenta M and yellow Y, change to halftone is performed to give an effect of contact screening to the respective images of the three primary colors at the same angles, those portions of the dot areas of each of the images of the three colors that overlap with dot areas of either one of the images of the other two colors to give a resultant optical image of a secondary color in the colored original are changed to corresponding dot areas of the secondary color obtainable by blending such two colors, those portions of dot areas of the images of the three colors that overlap all together to give a resultant optical image of a tertiary color in the colored original are changed to corresponding dot areas of the tertiary color obtainable by blending the three colors so that each pixel is expressed by a combination of at most three colors, including one of the primary colors, one of the secondary colors and the tertiary color. A plate for each of the primary, secondary and tertiary colors is respectively made with raised portions representing printing elements being so arranged that the image of any one of the primary, secondary and tertiary colors does not overlap with the images of the other colors to give a compounded image reproducing the colored original. Thus, small dots on each plate are substantially reduced by the method according to the invention and when the outer surface of a cylindrical container is printed with a dry off-set printer using inks and plates for respective primary, secondary and tertiary colors, deterioration of the image quality due to dot gain and image reduction is minimized. As a result, it is possible to obtain non-overlap halftone-dot printing image on a cylindrical container more similar to an image obtainable by overlap halftone-dot printing.

What is claimed is:

1. A method of dry offset non-overlap half-tone dot printing of a colored original on the outer surface of a cylindrical container, comprising the steps of:

color separating a colored original of a print to be provided on the outer surface of the cylindrical container into three primary colors, cyan, magenta and yellow;

effecting a change-to-halftone to convert the color density of each of said three primary colors obtained by said color separation into proportional dot areas;

changing those portions of said dot areas of each of said primary colors that overlap with said dot areas of either one of the other said primary colors to give a resultant optical image of a secondary color in said colored original into corresponding dot areas of said secondary color, obtainable by blending two of said three primary colors with each other to produce cyan-magenta, magenta-yellow or yellow-cyan;

changing those portions of said dot areas of each of said primary colors that overlap with said dot areas of both of the other two said primary colors in said colored original into corresponding dot areas of a tertiary color, obtainable by blending said three primary colors together;

making an offset printing plate for each of said primary, secondary and tertiary colors, each said printing plate having raised portions representing printing elements in said plate being so arranged that an image produced by said plate for any one of said primary, secondary and tertiary colors does not overlap with images produced by said plates for the said other colors to give a compounded image reproducing the colored original;

kneading an ink of each of said primary, secondary and tertiary colors with a plurality of ink distributing rollers and supplying said ink to said raised portions of said plate for a respective said color;

transferring each said kneaded ink on said raised portions of said plate one color after another onto a common offset printing blanket, and further transferring said inks of all said colors on said blanket simultaneously onto the outer surface of the cylindrical container;

wherein said step of effecting a change-to-halftone comprises giving an effect of contact screening at the same angle for all said primary colors and forming pixels defined by screen pitch in contact screening so as to produce a compounded image on the outer surface of the cylindrical container consisting of at most three colors including one of said three primary colors, one of three secondary colors obtainable by blending any two of said three primary colors, and said tertiary color.

* * * * *